US008312633B2

(12) United States Patent
Garman et al.

(10) Patent No.: US 8,312,633 B2
(45) Date of Patent: Nov. 20, 2012

(54) ELECTRIC CAN OPENER HAVING REMOVABLE OPENER TOOLS

(75) Inventors: Michael Garman, Midlothian, VA (US); Brandon Song, Midlothian, VA (US)

(73) Assignee: Hamilton Beach Boards Inc, Glen Allen, VA (US)

( * ) Notice: Subject to any disclaimer, the term of this patent is extended or adjusted under 35 U.S.C. 154(b) by 0 days.

(21) Appl. No.: 13/329,644

(22) Filed: Dec. 19, 2011

(65) Prior Publication Data

US 2012/0090097 A1 Apr. 19, 2012

Related U.S. Application Data

(63) Continuation of application No. 12/769,003, filed on Apr. 28, 2010, now Pat. No. 8,079,152, which is a continuation of application No. 11/969,542, filed on Jan. 4, 2008, now abandoned.

(51) Int. Cl.
*B67B 7/78* (2006.01)

(52) U.S. Cl. ..... 30/400; 30/408; 30/412; 30/416; 30/450; D8/33; D8/36; D8/37

(58) Field of Classification Search ..... 30/416–430, 30/1.5, 434, 450, 151–156, 408, 412; 83/167; 81/3.09, 3.4; D8/33, 36, 37
See application file for complete search history.

(56) References Cited

U.S. PATENT DOCUMENTS

| | | | | | |
|---|---|---|---|---|---|
| 2,187,386 | A * | 1/1940 | Strocco et al. | ..... | 225/73 |
| 3,439,417 | A * | 4/1969 | Miller et al. | ..... | 30/401 |
| 3,942,247 | A * | 3/1976 | Ponczek et al. | ..... | 30/408 |
| 3,950,801 | A * | 4/1976 | Morrison | ..... | 7/152 |
| 4,334,332 | A * | 6/1982 | Downs | ..... | 7/150 |
| 4,561,182 | A * | 12/1985 | Yamamoto et al. | ..... | 30/433 |
| 4,561,548 | A * | 12/1985 | Call | ..... | 211/70.7 |
| D311,668 | S * | 10/1990 | Bryant et al. | ..... | D8/40 |
| 5,676,440 | A * | 10/1997 | Garber et al. | ..... | 312/245 |
| 5,775,518 | A * | 7/1998 | Connor | ..... | 211/70.7 |
| D407,614 | S * | 4/1999 | Levin et al. | ..... | D8/34 |
| D417,129 | S * | 11/1999 | Brady et al. | ..... | D8/35 |
| 6,105,468 | A * | 8/2000 | Fohrman et al. | ..... | 81/3.09 |
| 6,253,662 | B1 * | 7/2001 | Zelson | ..... | 99/279 |
| 6,374,443 | B1 * | 4/2002 | Ancona et al. | ..... | 7/110 |
| 6,470,521 | B1 * | 10/2002 | Ancona et al. | ..... | 7/110 |
| 6,832,543 | B2 * | 12/2004 | Siano et al. | ..... | 99/340 |
| 7,004,049 | B2 * | 2/2006 | So et al. | ..... | 81/3.09 |
| 7,028,359 | B2 * | 4/2006 | Mazur | ..... | 7/156 |
| D520,313 | S * | 5/2006 | Miller | ..... | D8/36 |
| 7,168,337 | B2 * | 1/2007 | Carmo | ..... | 81/3.43 |
| 7,240,589 | B2 * | 7/2007 | Kehoe | ..... | 81/3.09 |
| 7,841,093 | B1 * | 11/2010 | Brady et al. | ..... | 30/408 |
| 2003/0188442 | A1 * | 10/2003 | Imer | ..... | 30/400 |
| 2005/0252343 | A1 * | 11/2005 | Turner | ..... | 81/3.09 |

* cited by examiner

*Primary Examiner* — Andrea Wellington
*Assistant Examiner* — Omar Flores Sanchez
(74) *Attorney, Agent, or Firm* — Alexander D. Raring

(57) ABSTRACT

An electric can opener for opening a top of a metal can which includes a housing that has a top end and a front side. A can cutting mechanism is on the front side of the housing proximate the top end of the housing. A hand held jar grip is removably mounted on the top end of the housing. The housing includes an opening that at least partially receives an opener tool.

8 Claims, 5 Drawing Sheets

ELECTRIC CAN OPENER HAVING REMOVABLE OPENER TOOLS

CROSS-REFERENCE TO RELATED APPLICATIONS

This application is a continuation of copending U.S. patent application Ser. No. 12/769,003, filed Apr. 28, 2010, which is a continuation of U.S. patent application Ser. No. 11/969,542, filed Jan. 4, 2008, and entitled "Electric Can Opener Having Removable Opener Tools," the disclosures of which are incorporated herein by reference.

BACKGROUND OF THE INVENTION

This invention generally relates to an electric can opener and, more particularly, to an electric can opener having a removable jar grip and a removable hand held bottle and package opener tool.

Foodstuff comes in a variety of metallic and plastic containers and packages. In order to protect the foodstuff during shipping and to ensure that the food is fresh and has not been tampered with, the containers and packages are tightly closed and often difficult to open with bare hands alone. There has long been a myriad of tools and appliances known in the art for opening such containers and packages. Electric can openers are well known in the art for opening a metallic can. The can opener has a housing for protecting the electronics and for supporting the can opener on a surface such that the can is suspended and supported by the can opener during the process of cutting through the top. Jar grips, having a high friction coefficient, even when wet, are known in the art for assisting in the twisting of an otherwise slippery lid such as a metallic lid used on glass jars. Additionally, a variety of hand held bottle openers are used to assist in opening bottle caps and package openers, having a slot with a recessed blade are used to open clam shell packages.

Though the above tools enable a person to open an assortment of containers and packages, kitchens are often extremely cluttered with foodstuff items, cooking utensils and miscellaneous household items. The tools for opening containers and packages often become separated and are difficult to find. Even in the most organized kitchens, the electric appliances used on a daily basis, such as the electric can opener, are often left on the countertop, while the hand held opening tools are kept in a drawer containing other items. The hand held openers often become misplaced and are difficult to find defeating the time saving benefit of having such tools.

What is therefore needed, but not provided in the prior art, is an electric can opener that includes a removably mounted jar grip and a removably mounted hand held container and package opener. What is also desired, but not provided in the prior art, is a hand held container and package opener that combines a clam shell package opener, a pull tab opener, a pop-top bottle opener and a twist top bottle opener in a single hand held device.

BRIEF SUMMARY OF THE INVENTION

Briefly stated, the present invention is directed to an electric can opener for opening a top of a metallic can. The can opener includes a housing that has a top end and a front side. A can cutting mechanism is on the front side of the housing proximate the top end of the housing. A hand held jar grip is removably mounted on the top end of the housing. The top end of the housing includes a recess that receives an interior surface of the hand held jar grip.

In another aspect, the invention is directed to a hand held bottle and package opener tool for opening packaging and foodstuff containers. The opener tool includes a body that has first and second ends, a top side and a bottom side. A pop-top opener is positioned toward the first end of the body. The pop-top opener includes a pivot arm and a prying plate spaced from the pivot arm for prying open crown sealed bottles. A twist-top opener is positioned on the top side of the body. The twist top-opener is conically tapered. A pull-tab opener is positioned toward the first end of the body. A package opener is on the bottom side of the body and includes a recessed groove and an angled blade that extends at least partially across the groove.

BRIEF DESCRIPTION OF THE SEVERAL VIEWS OF THE DRAWINGS

The foregoing summary, as well as the following detailed description of a preferred embodiment of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown.

In the drawings.

DETAILED DESCRIPTION OF THE INVENTION

Figure 1:
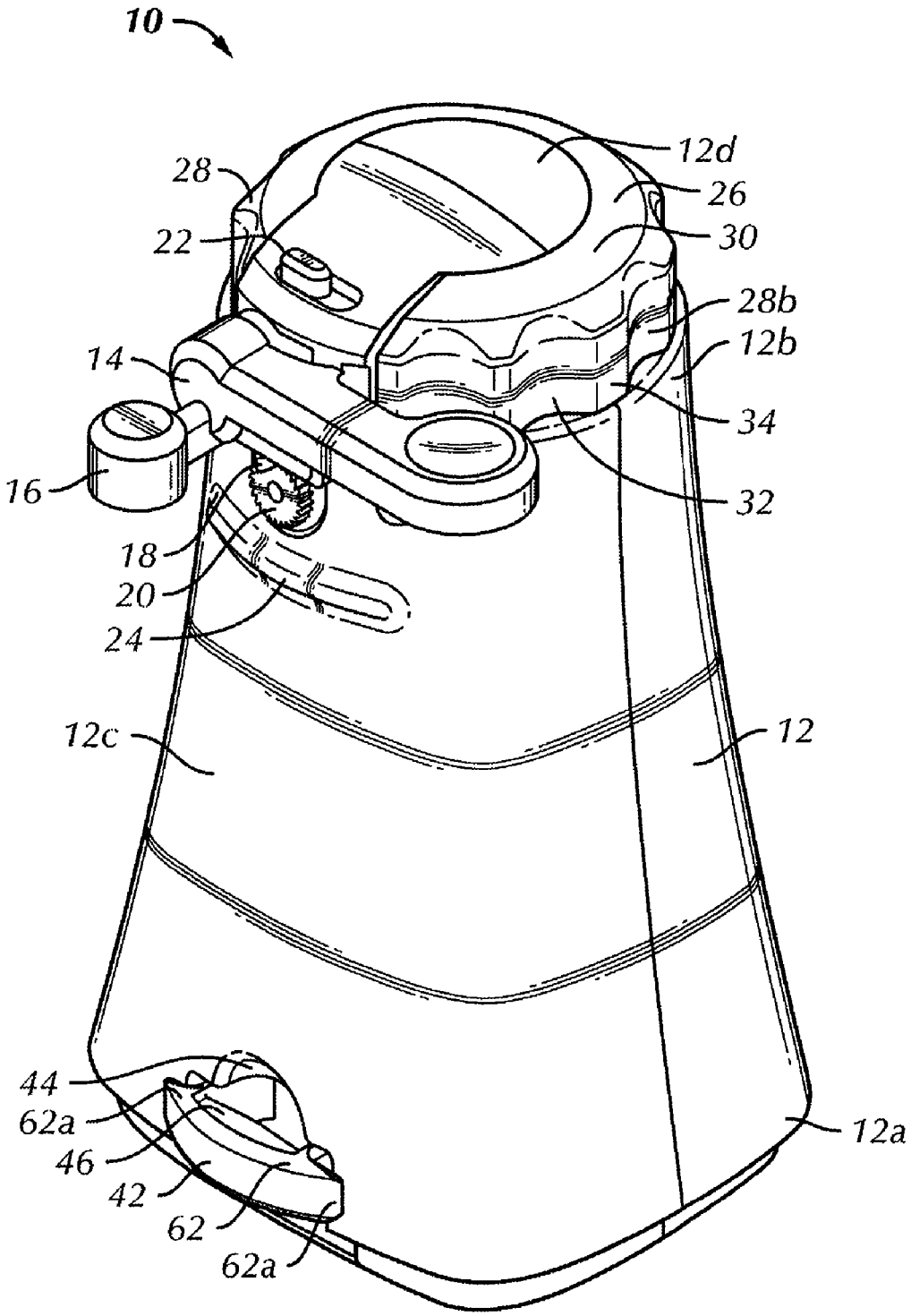
FIG. 1 is a perspective view of an electric can opener having a removable jar grip and a removable opener tool in accordance with a preferred embodiment of the present invention.

Certain terminology is used in the following description for convenience only and is not limiting. The words "right", "left", "lower" and "upper" designate directions in the drawings to which reference is made. The words "inwardly" and "outwardly" refer to directions toward and away from, respectively, the geometric center of a can opener in accordance with the present invention, and designated parts thereof. Unless specifically set forth herein, the terms "a", "an" and "the" are not limited to one element but instead should be read as meaning "at least one". The terminology includes the words noted above, derivatives thereof and words of similar import.

Referring to the drawings, wherein like numerals indicate like elements throughout, there is shown a preferred embodiment of an electric can opener having removable opening tools ("can opener"), generally designated 10. The can opener 10 is preferably a self supporting electric can opener for opening a top of a metal can (not shown).

Figure 2:
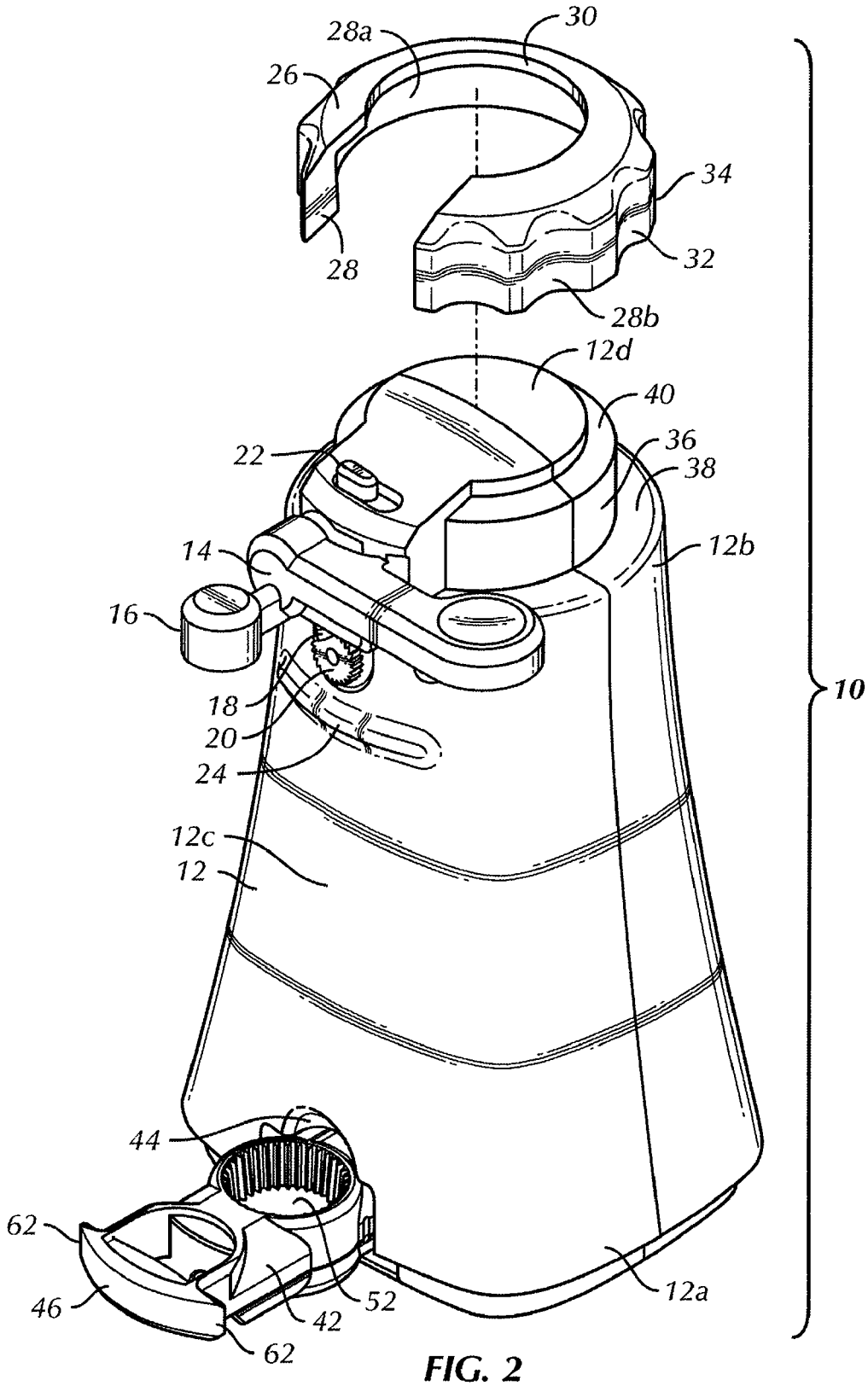
FIG. 2 is an exploded perspective view of the electric can opener shown in FIG. 1.

Referring to FIGS. 1 and 2, the can opener 10 is comprised of a housing 12. The housing 12 encases an electric motor and other electrical components (not shown) of the can opener 10. The housing 12 has a bottom end 12*a* for supporting the can opener 10 on a support surface such as a countertop (not shown). The housing 12 has a top end 12*b* opposed from the bottom end 12*a*. A front side 12*c* extends between the bottom end 12*a* and the top end 12*b* of the housing 12. The can opener 10 includes a cutting mechanism 14 on the front side 12*c* of the housing 12 proximate the top end 12*b* of the housing 12. The cutting mechanism 14 preferably includes a magnetized arm 16 for retaining the top of the can once it is cut, a cutting blade 18 for piercing and cutting off the top of the can and a spiked wheel 20 that is powered by the electric motor to rotate the can as it is cut. A releasing button 22 is also preferably provided proximate the top end 12*b* of the housing 12. Pressing the releasing button 22 separates the blade 18 and the wheel 20 to thereby release the can from the cutting mechanism 14 once the top has been opened. An outwardly extending ridge 24 may be provided on the front side 12*c* of the housing 12 in order to better position the can between the blade 18 and the wheel 20 and to help maintain the can with an upright orientation during rotation. Though a can opener 10 preferably includes the cutting mechanism 14, the releasing button 22 and the ridge 24 as described above and shown in FIGS. 1-2, the can opener 10 is not limited to such a configuration and may include any mechanism and features that enable and assist the can opener 10 in cutting and or removing the top of a metal can.

Figure 3:
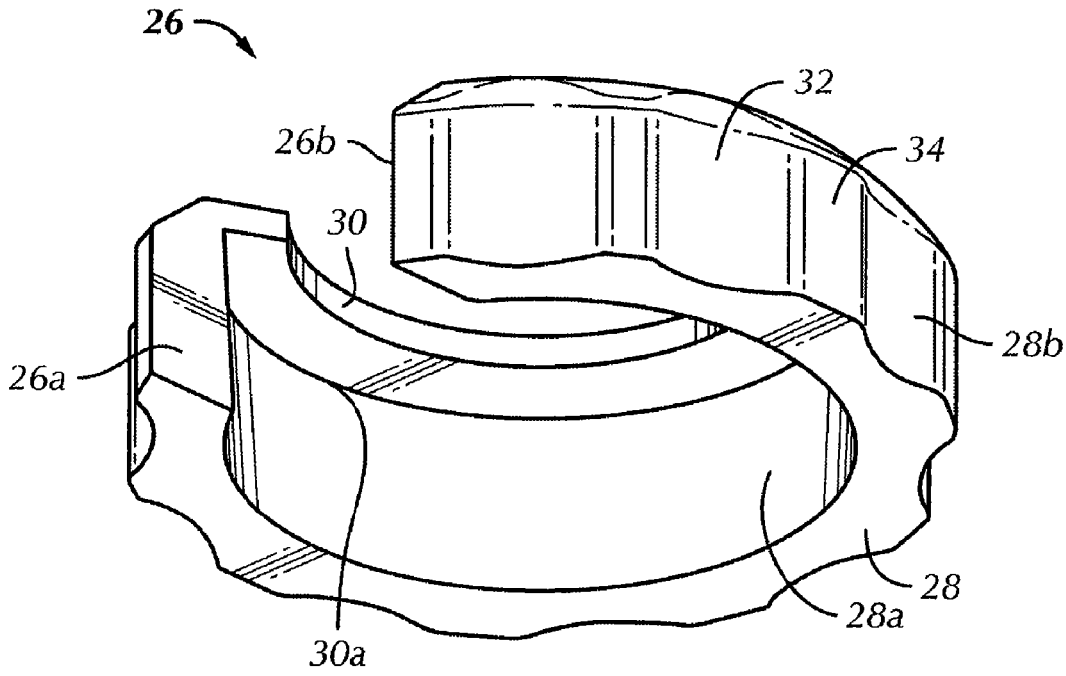
FIG. 3 is an enlarged bottom perspective view of the jar grip shown in FIG. 1.

Referring to FIGS. 1-3, a hand-held jar grip 26 is removably mounted on the top end 12*b* of the housing 12. The jar grip 26 is preferably comprised of elastomeric material that assists in opening a container such as a glass container with a metal lid (not shown). Though an elastomeric material is preferred, the jar grip 26 may be made of any material that maintains a higher coefficient of friction than a human hand against a low coefficient surface such as a metallic lid. The jar grip 26 is preferably generally in the shape of a C-shaped ring. The C-shape enables the jar grip 26 to conform to a plurality of lid size diameters by bringing spaced ends 26*a*, 26*b* of the jar grip 26 closer together. The C-shape of the jar grip 26 also enables the jar grip 26 to be more easily positioned over a lid by separating the spaced ends 26*a*, 26*b* further apart when placing the jar grip 26 over the lid. The jar grip 26 has a circumferentially extending sidewall 28 and a radially inwardly extending upper flange 30, the sidewall 28 has a generally curved smooth inner surface 28*a* that tapers inwardly in diameter away from the upper flange 30. The inner surface 28*a* and the upper flange 30 form a circumferentially extending corner 30*a* that preferably forms an acute angle. In use, the outer periphery of the lid is preferably positioned into the corner 30*a*. The tapering of the inner wall 28*a* allows for the jar grip 26 to be more securely placed over the rim of the jar lid such that the maximum surface area of the upper flange 30 and the inner surface 28*a* contact the lid. The side wall 28 preferably has a ridged outer surface 28*b*. The ridged outer surface 28*b* is preferably comprised of a series of oscillating valleys 32 and ridges 34 to provide enhanced grip on a user's hand during use. The ridges 34 are preferably circumferentially spaced around the outer periphery of the jar grip 26. Though the above configuration for the jar grip 26 is preferred, it is within the spirit and scope of the present invention that the jar grip 26 be comprised of any shape suitable for gripping a lid of a jar. For example, the jar opener 26 may be a complete ring and or top and may have differently shaped inner and outer surfaces. The inner 28*a* or outer surface 28*b* may also be textured to enhance grip.

Referring specifically to FIG. 2, the can opener 10 preferably includes a recess 36 positioned toward the top end 12*b* of the housing 12 to receive the inner surface 28*a* and upper flange 30 of the jar grip 26. The recess 36 is preferably comprised of a first inward step 38 and a second inward step 40. The horizontal depth of the first inwardly extending step 38 is preferably equal to the thickness of the side wall 28 such that the ridges 34 are generally flush with the housing 12 and the vertical depth of the second inwardly extending step 40 is preferably equal to the thickness of the upper flange 30 such that the outer surface of the upper flange 30 is generally flush with a top surface 12*d* of the housing 12. Though it is preferred that the jar grip 26 sit on the recess 36, the jar grip 26 may be attached to the can opener 10 in any suitable manner such as in a concealed slot, a holster type compartment or hook hanger and may be positioned anywhere on or in the housing 12.

In use, a user who is having difficulty opening a jar lid due to slippery conditions and/or a jar having a tight seal, utilizes the jar grip 26 in order to obtain a better grip (i.e. higher coefficient of friction between the user's hand and the jar lid). The user removes the jar grip 26 from the housing 12 and then places the jar grip 26 over the lid of the jar until the upper flange 30 contacts the lid. The user then squeezes the jar grip 26 thereby conforming the inner wall 28 to the diameter and shape of the lid. The user then twists the jar grip 26 (typically counterclockwise with respect to the jar) thereby twisting and opening the jar lid from the jar. The user then places the jar grip 26 back onto the housing 12.

Referring to FIGS. 1-2, and 4-6, the can opener 10 also includes an opener tool 42. The can opener 10 may include both the jar grip 26 and the opener tool 42, only one of the jar grip 26 and can opener 10 or additional opening tools. The opener tool 42 is preferably a hand held bottle and package opener tool that is removably received or contained within the housing 12. The opener tool 42 is preferably slideably inserted into an opening in the housing 12 through the front side 12*c* of the housing 12 along a horizontal plane generally perpendicular to the front side 12*c* of the housing 12. However, it is within the spirit and scope of the present invention that the opener tool 42 be positioned anywhere in or on the housing 12 and be removably mounted to or positioned within the housing 12 in any suitable manner. The housing 12 preferably includes an inwardly extending opening or indent 44 on the front side 12*c* of the housing 12 above the opener tool 42 for accessing the opener tool 42 with an index finger.

Figure 4:
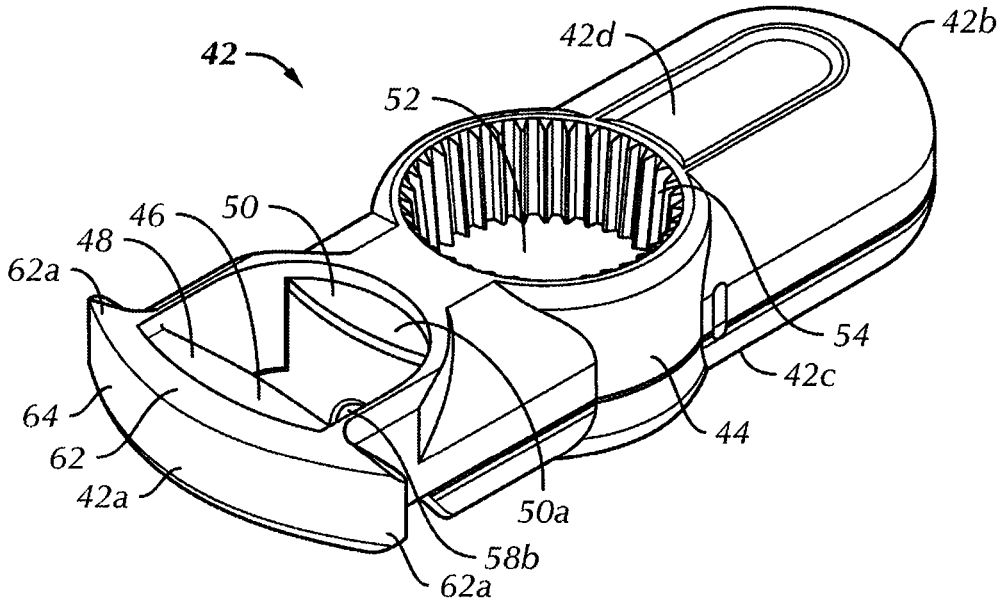
FIG. 4 is an enlarged top perspective view of the opener tool shown in FIG. 1.
Figure 5:
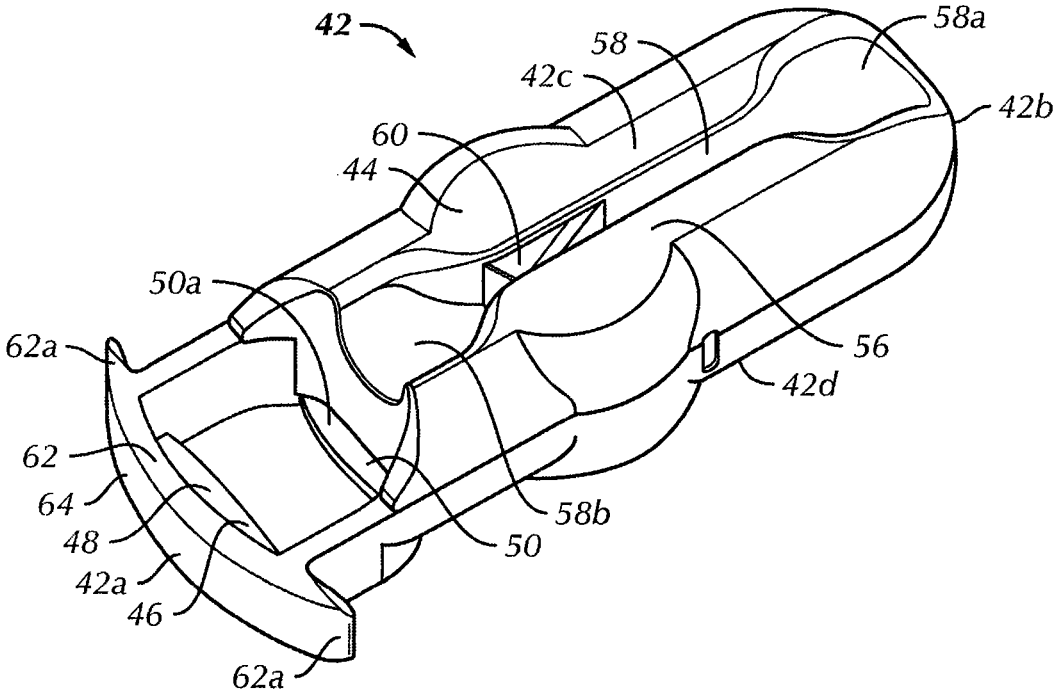
FIG. 5 is an enlarged bottom perspective view of the opener tool shown in FIG. 1.
Figure 6:
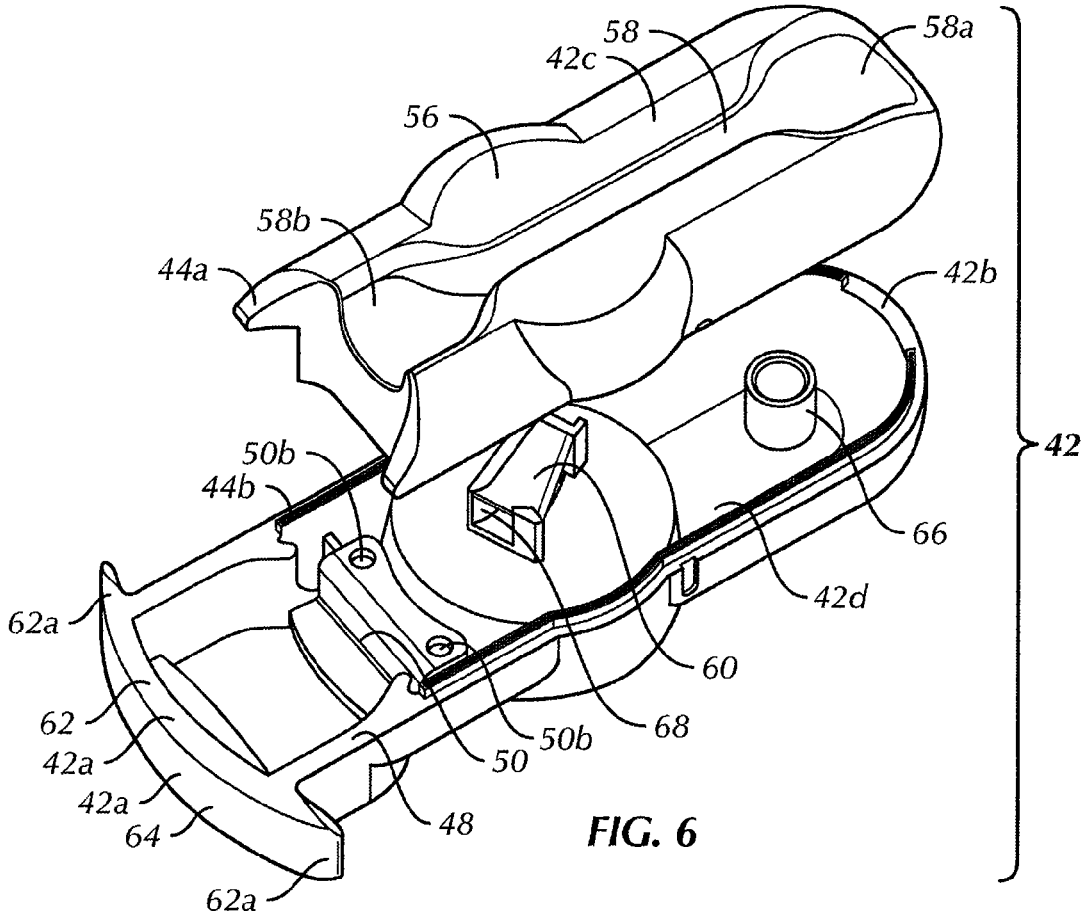
FIG. 6 is an enlarged partially exploded bottom perspective view of the opener tool shown in FIG. 1.

Referring specifically to FIGS. 4-6, the opener tool 42 has a body 44 that is preferably comprised of two molded acrylonitrile butadiene styrene (ABS) halves 44*a*, 44*b* that are snap fit together. The opener tool 42 may be constructed of any material and may be molded or otherwise constructed of a single piece. The opener tool 42 has a first end 42*a*, a second end 42*b*, a bottom side 42*c* and a top side 42*d*.

The opener tool 42 includes a pop-top opener 46 for removing the crown seal bottle cap of a crown cork bottle (not shown) and is positioned toward the first end 42*a*. The pop-top opener 46 preferably extends from the front side 12*c* of the housing 12 when received or contained within the housing 12. The pop top opener 46 includes an arched-shaped pivot arm 48 that extends from the body 44 toward the first end 42*a*. A prying plate 50 also extends from the body 44 toward the first end 42*a*. The pivot arm 48 extends further the body 44 than the prying plate 50 such that the pivot arm 48 is spaced from the prying plate 50. The prying plate 50 is preferably comprised of a rigid material such as aluminum or steel and is sandwiched between the halves 44*a*, 44*b* of the body 44 such that at least a portion 50*a* of the prying plate 50 extends from the body 44.

The opener tool 42 also includes a twist-top opener 52 for removing a twist polymeric or metallic bottle or container cap (not shown) and is positioned on the top side 42*d* of the body 44. The twist-top opener 52 preferably extends into the body 44 of the opener tool 42 such that the top of the twist-top opener 52 is flush with the body 44 and is preferably conically tapered. The twist-top opener 52 may extend radially further outwardly than the remainder of the body 44 or the body 44 may bulge outwardly in order to accommodate the twist-top opener 52. The twist-top opener 52 also preferably includes a plurality of axially extending and radially protruding ridges 54 that are circumferentially spaced around the inner periphery of the twist-top opener 52 for providing enhanced grip to the container cap. Though it is preferred that the twist-top opener 52 be formed directly from the molding process of the body 44, the twist-top opener 52 may be separately mounted and or constructed of a different material such as aluminum or steel.

The opener tool also includes a package opener 56 for opening clamshell thermoplastic packaging and is positioned on the bottom side 42*c* of the body 44. The package opener 56 includes an axially extending recessed groove 58 and an angled blade 60. The blade 60 is generally parallel to the prying plate 50 and extends at least partially across the groove 58 such that an object sliding within and along the groove 58 contacts the blade 60 and is cut open by the blade 60 but an object such as a finger or hand does not fit within the groove 58 and therefore does not contact the blade 60. The blade 60 is preferably mounted on a stand 68 and then is sandwiched between the halves 44*a*, 44*b* to prevent the blade 60 from moving. The groove 58 preferably flares outwardly toward each the first and second end 42*a*, 42*b* of the body 44 at grooves ends 58*a*, 58*b* such that an object is more easily received and removed from the groove 58, respectively.

The opener tool 42 further includes a pull-tab opener 62 positioned toward the first end 42*a* of the body 44 for opening a metallic container having a pull-tab lid (not shown). The pull-tab opener 62 is comprised of a pair of pry arms 62*a* extending outwardly from the pivot arm 48 of the pop-top opener 46. The pry arms 62*a* preferably extend generally orthogonally from the body 44. The pivot arm 48 preferably has an arcuate surface 64 extending between the pry arms 62*a*. The arcuate surface 64 allows for one of the pry arms 62*a* to be placed underneath the pull-tab and then act as a fulcrum as the opener tool 42 is pivoted away from the pull-tab.

In use, when the user desires to open a container or package, the opener tool 42 is slid out or otherwise removed from the housing 12 of the can opener 10. If the user is trying to open a crown sealed bottle such as is typically found on a beer bottle (not shown), the opener tool 42 is placed in the palm of a user's hand with the bottom side 42*c* facing the palm and the top side 42*d* facing away from the user's palm. The pivot arm 48 is then placed on top of the crown seal cap while the hand not holding the opener tool 42 grasps the bottle to be opened. The prying plate 50 is placed under the rim of the crown seal cap and then the user lifts the second end 42*b* of the body 44 upwardly such that the prying plate 50 bends the top of the metallic crown seal cap. Once the crown seal cap is sufficiently bent, the crown seal cap can be easily removed from the bottle.

If the user wishes to open a bottle with a twist seal or a beverage container with a polymeric twist-top such as is typically found on a soda bottle (not shown), the user grasps the opener tool 42 with the bottom side 42*c* facing the user's palm and the twist-top opener 52 facing away from the user's palm. The twist-top opener 52 is then placed over the top of the container (not shown) such that the ridges 54 engage with and grip the ridges of the twist-top. The user then twists the opener tool 42 in a direction perpendicular to the ridges 54 to thereby release the twist-top from the container.

If the user desires to open a metal lid having a pull-tab such as a soup or fruit can (not shown), the user grasps the opener tool 42 such that the second end 42*b* extends from the closed grip of the user by the thumb. The user then places the pry arm 62*a* underneath the pull-tab and then pivots the opener tool 42 by pulling back on the second end 42*b* until the lid of the can is sufficiently opened.

If the user wishes to open a clamshell packaging, envelope or any other package that can be opened by cutting off a generally thin edge of the package, the user grasps the opener tool 42 with the twist top opener 52 facing the user's palm and the package opener 56 facing away from the user's palm. The package is then slid into the groove 58 and into contact with the blade 60 to thereby cut off an edge of the package. Once the user is finished with the opener tool 42, the user then places the opener tool 42 back onto or into the housing 12.

Though the preferred containers and packages are opened in the manner set forth above, it is within the spirit and scope of the present invention that the opener tool 42 be used in any suitable manner for opening the desired container or package and additional packages and containers be opened with the present opening tools 48, 52, 56, 62 or that the opener tool 42 include additional opening devices (not shown).

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

We claim:

1. An electric can opener, the can opener comprising:

a housing encasing an electric motor and the housing comprising a top end opposed from a bottom end and a front side extending between the bottom end and the top end;

a can cutting mechanism on the front side of the housing proximate the top end of the housing, the cutting mechanism including a magnetized arm, a cutting blade, and a spiked wheel, the spiked wheel powered by the electric motor;

a hand held jar grip removably mounted on the can opener; and an opener tool at least partially received within the housing along a horizontal plane substantially perpendicular to the front side of the housing via an opening in the housing into which the opener tool is slidably insertable, the opener tool comprising a) a body with a first end, a second end, a bottom side and top side, b) an pop-top opener positioned toward the first end, the pop-top opener extending from the housing when the opener tool is at least partially received by the housing, and the pop-top opener including an arched-shaped pivot arm that extends from the body toward the first end, a prying plate extending from the body toward the first end where the pivot arm extends further from the body than the prying plate so that the pivot arm is spaced from the prying plate, c) a twist-top opener extending into the body of the opener tool and defining an inner periphery, the twist-top opener comprising, relative to the twist-top opener, a plurality of axially extending and radially protruding ridges with the ridges circumferentially spaced around the inner periphery, d) a package opener position on the body opposite the twist-top opener, the package opener comprising, relative to the body, an axially extending recessed groove and an angled blade, the blade being generally parallel to the prying plate and extending at least partially across the groove, the groove flaring outwardly toward each of the first and second ends of the body at each end of the groove, and e) a pull-tab opener positioned toward the first end of the body, the pull-tab opener comprising a pair of pry arms extending outwardly form the pivot arm of the pop-top opener and the pivot arm defining an arcuate surface extending between the pry arms.

2. The can opener of claim 1, wherein the jar grip is comprised of an elastomeric material.

3. The can opener of claim 1, wherein the jar grip is generally in the shape of a C-shaped ring.

4. The can opener of claim 3, wherein the jar grip has a radially inwardly extending upper flange.

5. The can opener of claim 1, wherein the jar grip has a plurality of circumferentially spaced ridges.

6. The can opener of claim 1, wherein the prying plate is metal.

7. The can opener of claim 6, wherein the prying plate is sandwiched between two halves of the body.

8. The can opener of claim 1, wherein the opener tool body is comprised of a polymeric material and the prying plate of the pop-top opener is comprised of a metallic material.

* * * * *